US009590372B2

(12) United States Patent
Woo et al.

(10) Patent No.: US 9,590,372 B2
(45) Date of Patent: Mar. 7, 2017

(54) CONNECTOR AND LAUNDRY TREATMENT APPARATUS HAVING THE SAME

(71) Applicant: LG ELECTRONICS INC., Seoul (KR)

(72) Inventors: Seyoung Woo, Seoul (KR); Sanghun Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 183 days.

(21) Appl. No.: 14/532,200

(22) Filed: Nov. 4, 2014

(65) Prior Publication Data

US 2015/0123523 A1 May 7, 2015

(30) Foreign Application Priority Data

Nov. 4, 2013 (KR) ..... 10-2013-0132967

(51) Int. Cl.

| | |
|---|---|
| ***D06F 39/14*** | (2006.01) |
| ***H01R 27/00*** | (2006.01) |
| ***D06F 37/28*** | (2006.01) |
| ***D06F 39/00*** | (2006.01) |

(52) U.S. Cl.

CPC ..... *H01R 27/00* (2013.01); *D06F 37/28* (2013.01); *D06F 39/005* (2013.01); *D06F 39/14* (2013.01)

(58) Field of Classification Search

CPC ..... D06F 39/14; D06F 39/005; D06F 37/28; E05D 11/0081; B60R 16/0207; B60R 16/0215; H01R 12/91; H01R 27/00

USPC ..... 68/3 R, 196; 312/228, 326, 329, 405; 439/638, 32

See application file for complete search history.

(56) References Cited

U.S. PATENT DOCUMENTS

| | | | | |
|---|---|---|---|---|
| 5,545,061 | A * | 8/1996 | Sawayanagi | H01R 13/743 439/556 |
| 5,941,619 | A * | 8/1999 | Stieben | E05D 11/0081 16/223 |
| 7,494,418 | B2 * | 2/2009 | Rifkin | G07F 17/32 463/46 |

(Continued)

FOREIGN PATENT DOCUMENTS

| | | |
|---|---|---|
| CN | 103166326 A | 6/2013 |
| EP | 2 107 152 A1 | 10/2009 |
| WO | WO 2013/087774 A1 | 6/2013 |

OTHER PUBLICATIONS

Chinese Office Action dated Mar. 4, 2016 issued in Application No. 201410598978.2 (Full Chinese Text and English Translation).

(Continued)

*Primary Examiner* — Daniel J Troy
*Assistant Examiner* — Hiwot Tefera
(74) *Attorney, Agent, or Firm* — KED & Associates LLP

(57) ABSTRACT

A connector is provided that includes a cabinet connector at a cabinet that includes at least one of a power supply device and an information processing device and a device connector at a control object device to be controlled by at least one of the power supply device and the information processing device. The device connector may be separably coupled to the cabinet connector. The device connector may be movable along at least two of an X-axis and a Y-axis defining a plane parallel to a cross section of the cabinet connector and a Z-axis perpendicular to the cross section of the cabinet connector.

12 Claims, 11 Drawing Sheets

(56) References Cited

U.S. PATENT DOCUMENTS

| | | | | |
|---|---|---|---|---|
| 7,520,764 | B2 * | 4/2009 | Lee | H01R 13/743 439/153 |
| 7,980,088 | B2 * | 7/2011 | LeClear | H01R 31/06 62/331 |
| 8,299,656 | B2 * | 10/2012 | Allard | F25D 17/042 307/139 |
| 2006/0223351 | A1 * | 10/2006 | Kim | F25D 23/064 439/157 |
| 2008/0096407 | A1 * | 4/2008 | Lee | H01R 13/743 439/153 |
| 2008/0166915 | A1 * | 7/2008 | Kendall | H01R 31/06 439/527 |
| 2008/0172838 | A1 * | 7/2008 | Choi | E05D 15/505 16/366 |
| 2009/0121970 | A1 | 5/2009 | Ozbek | 345/4 |
| 2012/0083147 | A1 * | 4/2012 | Welch | H01R 25/162 439/215 |
| 2012/0161594 | A1 * | 6/2012 | Kim | D06F 39/14 312/228 |
| 2012/0187811 | A1 * | 7/2012 | Kim | E05D 3/10 312/228 |
| 2012/0242207 | A1 * | 9/2012 | Mershon | H01R 35/02 312/237 |
| 2014/0150472 | A1 * | 6/2014 | Boarman | F25B 21/02 62/56 |
| 2015/0194749 | A1 * | 7/2015 | Kim | H01R 9/16 312/404 |

OTHER PUBLICATIONS

European Search Report dated Dec. 23, 2014, issued in Application No. 14191494.5 (English Translation).

* cited by examiner

CONNECTOR AND LAUNDRY TREATMENT APPARATUS HAVING THE SAME

CROSS-REFERENCE TO RELATED APPLICATION

This application claims the benefit of Korean Patent Application No. 10-2013-0132967, filed Nov. 4, 2013, the subject matter of which is hereby incorporated by reference.

BACKGROUND

1. Field

Embodiments may relate to connectors for transmission of power or transmission/reception of data and laundry treatment apparatuses having the same.

2. Background

Laundry treatment apparatuses refer to apparatuses that may perform washing and/or drying of laundry such as clothes and the like. Laundry treatment apparatuses, which include a steam supply device and function to refresh laundry for removal of wrinkles, deodorization, elimination of static cling and the like, have become popular.

An aesthetic function of a variety of devices including laundry treatment apparatuses is increasingly a focus of attention. With regard to laundry treatment apparatuses, designs to enhance an aesthetic function have actively been studied.

For example, while a control panel has been mounted to a cabinet, laundry treatment apparatuses in which a control panel is installed to a rotatable door to pursue design diversity are on an increasing trend.

Electronic devices that need supply of power are increasingly installed to a door similar to a control panel.

In an example in which a control panel and electronic devices are installed to a door of a laundry treatment apparatus, there may be a need for wires or cables that connect a power supply device and an information processing device, incorporated in a main body of the laundry treatment apparatus, to the electronic devices installed in the door for power supply or data transmission to the electronic devices.

Laundry treatment apparatuses of disadvantageous arrangements may suffer from aesthetic deterioration and assembly efficiency due to a connection mechanism that connects a power supply device or an information processing device, incorporated in a main body of the laundry treatment apparatus, to any electronic device installed in a device that is separable from the main body or rotatably coupled to the main body.

Additionally, in an example in which a door pivotally rotatably coupled to a cabinet is provided at a left side or the a right side thereof with a hinge, disadvantageous arrangements may fail to solve difficulty in coupling of the power supply device or the information processing device and inconvenience in connection of a power line or a communication line.

BRIEF DESCRIPTION OF THE DRAWINGS

Embodiments may be described in detail with reference to the following drawings in which like reference numerals refer to like elements and wherein.

DETAILED DESCRIPTION

Figure 1:
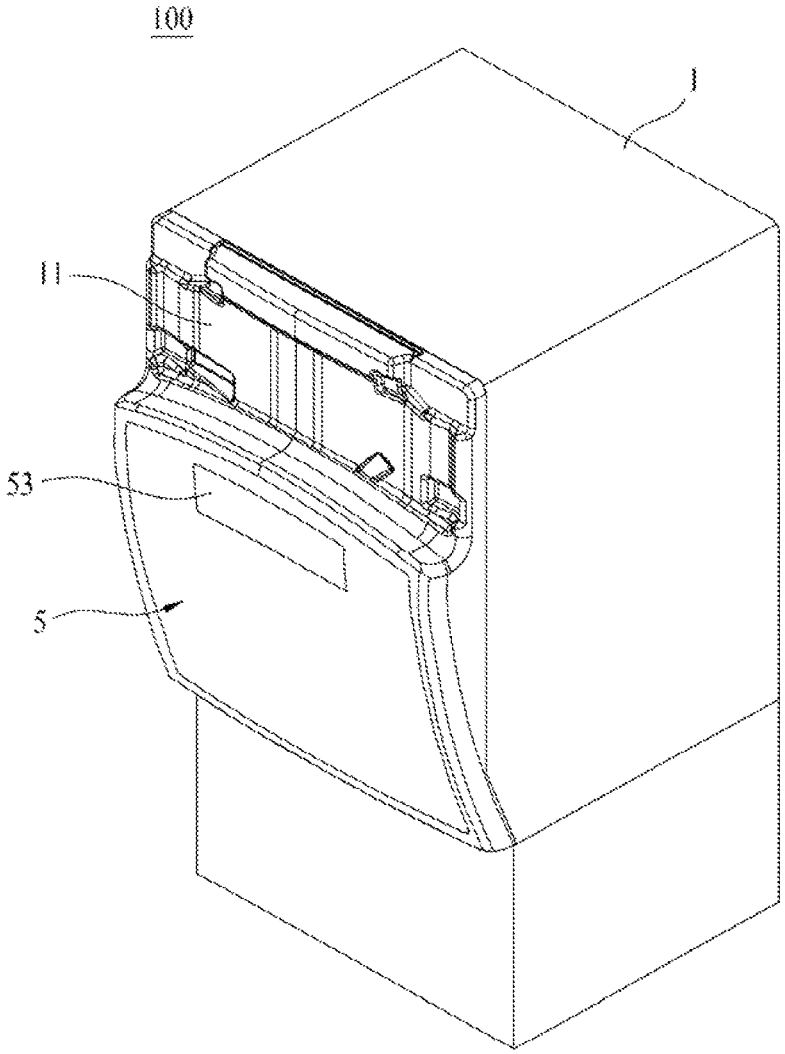
FIGS. 1 and 2 are views showing a laundry treatment apparatus according to an example embodiment.

Exemplary embodiments may be described below with reference to the accompanying drawings. Configurations or control methods of apparatuses that may be described below are provided only to explain embodiments and are not intended to restrict the scope of the embodiments. Wherever possible, the same reference numerals will be used throughout the specification to refer to the same or like parts.

Figure 2:
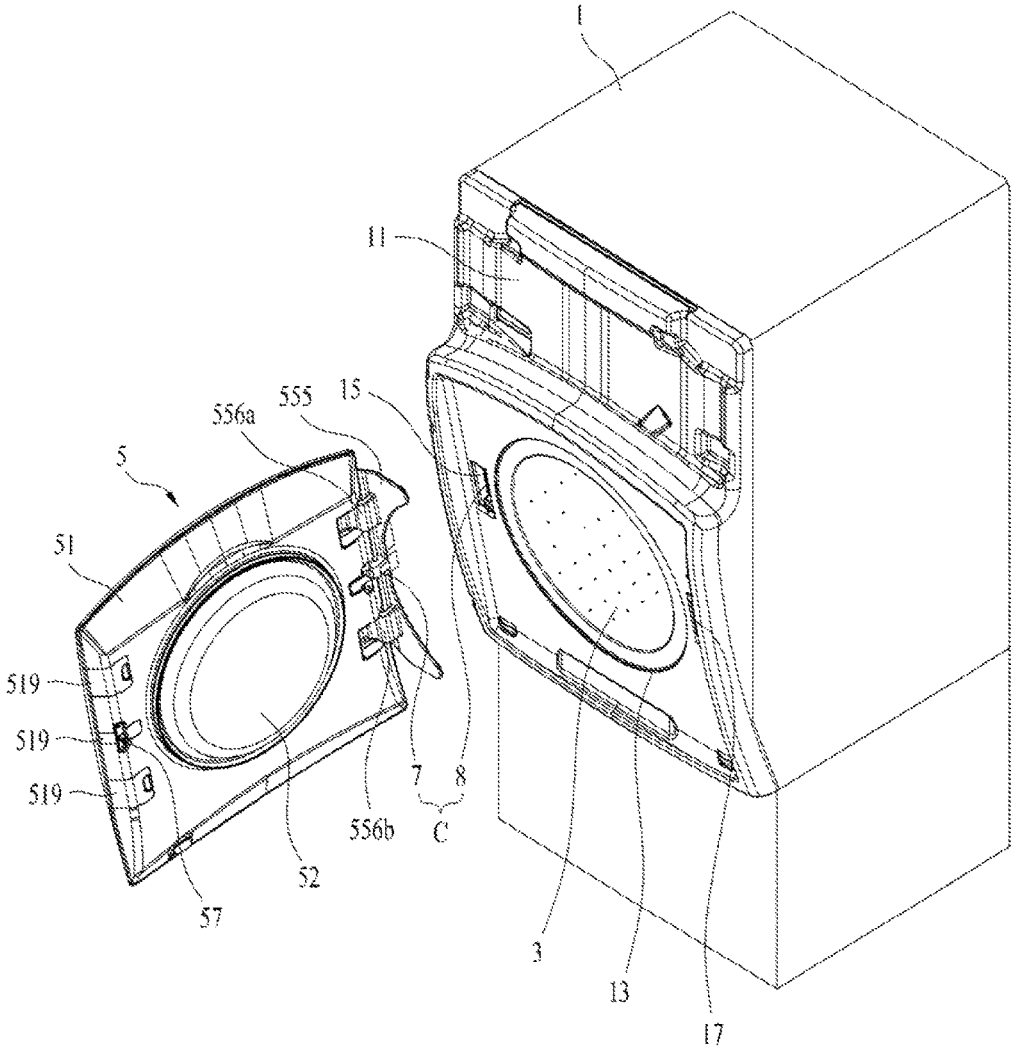

As shown in FIGS. 1 and 2, a laundry treatment apparatus 100 of an example embodiment, includes a cabinet 1 (or main body) defining an external appearance of the laundry treatment apparatus 100. The cabinet 1 may have an input opening 13. The laundry treatment apparatus 100 may include a laundry receptacle 3 placed within the cabinet 1 to store laundry introduced through the input opening 13, and a door 5 rotatably coupled to the cabinet 1 to open or close the input opening 13. The door 5 may be provided with a control panel 53.

The cabinet 1 may include a front panel 11 defining a front surface of the laundry treatment apparatus 100, and the input opening 13 may be perforated in the front panel 11 to communicate with the laundry receptacle 3. As such, a user may introduce laundry into the laundry receptacle 3 through the input opening 13 and remove the laundry stored in the laundry receptacle 3 from the cabinet 1.

Assuming that the laundry treatment apparatus 100 is to perform only a drying function, the laundry receptacle 3 may include only a drum rotatably placed within the cabinet 1.

In this example, the drum may be rotated by a drive device, such as a motor, mounted in the cabinet 1 and hot air may be supplied into the drum by an air supply device that includes a heater and a fan.

Assuming that the laundry treatment apparatus 100 is to perform only a washing function, the laundry receptacle 3 may include a tub placed within the cabinet 1 to store wash water therein, and a drum rotatably placed within the tub to store laundry therein.

The drum may be rotated by a drive device mounted at outside of the tub, and the tub may receive wash water via a water supply device that connects a water supply source provided at outside of the cabinet 1 and the tub to each other.

The wash water stored in the tub may be discharged out of the cabinet 1 through a drain device within the cabinet 1.

Assuming that the laundry treatment apparatus 100 is to perform both laundry washing and drying functions, the laundry receptacle 3 may include a tub and a drum, and all of the aforementioned devices including the drive device, the hot air supply device, the water supply device and the drain device may be in the cabinet 1.

Figure 6:
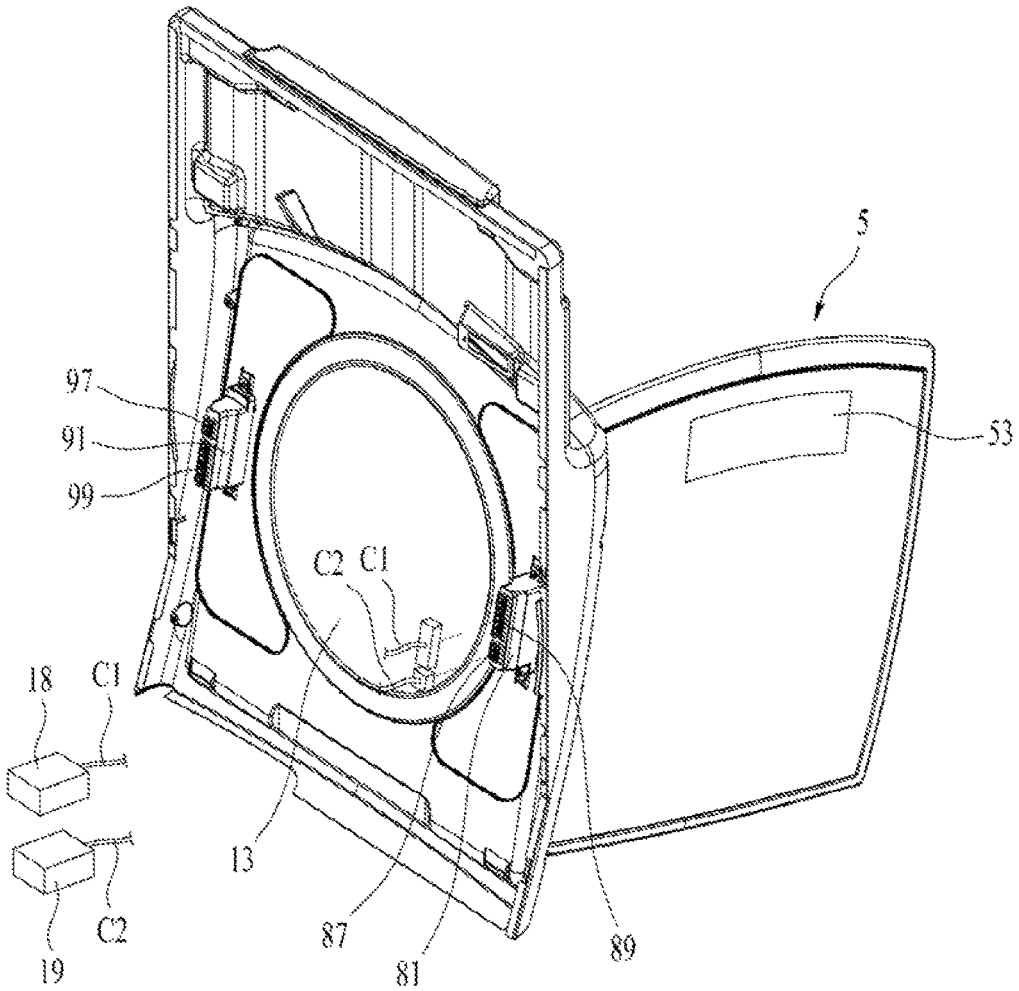

The aforementioned devices including the drive device, the hot air supply device, the water supply device and the drain device and various other electronic devices in the cabinet 1 are configured to receive power via a power supply device 19 (i.e., a power source) shown in FIG. 6. The power supply device 19 may be configured to supply power to the respective electronic devices based on a control signal provided by an information processing device 18 (i.e., a controller) shown in FIG. 6.

The electronic devices including the power supply device 19 are connected to the information processing device 18 to enable transmission/reception of data, and the respective electronic devices may perform set functions based on control signals provided by the information processing device 18.

As shown in FIG. 2, the door 5 may serve to open or close the input opening 13.

The door 5 may include a door frame 51 provided with the control panel 53 and a hinge unit 55 to rotatably secure the door frame 51 to the cabinet 1.

The control panel 53 (i.e., a control object device) may serve to allow a user to input a control command to the laundry treatment apparatus 100 and to display control information of the laundry treatment apparatus 100. The control panel 53 may receive input information and output information. The control panel 53 is an electronic device that has to receive power from the power supply device 19 and requires exchange of data and control signals with the information processing device 18.

Embodiments may require means or device, such as a connector C, to electrically connect the control panel 53 (installed to the door 5) to the power supply device 19 and the information processing device 18 installed in the cabinet 1. This may be described below.

Figure 3:
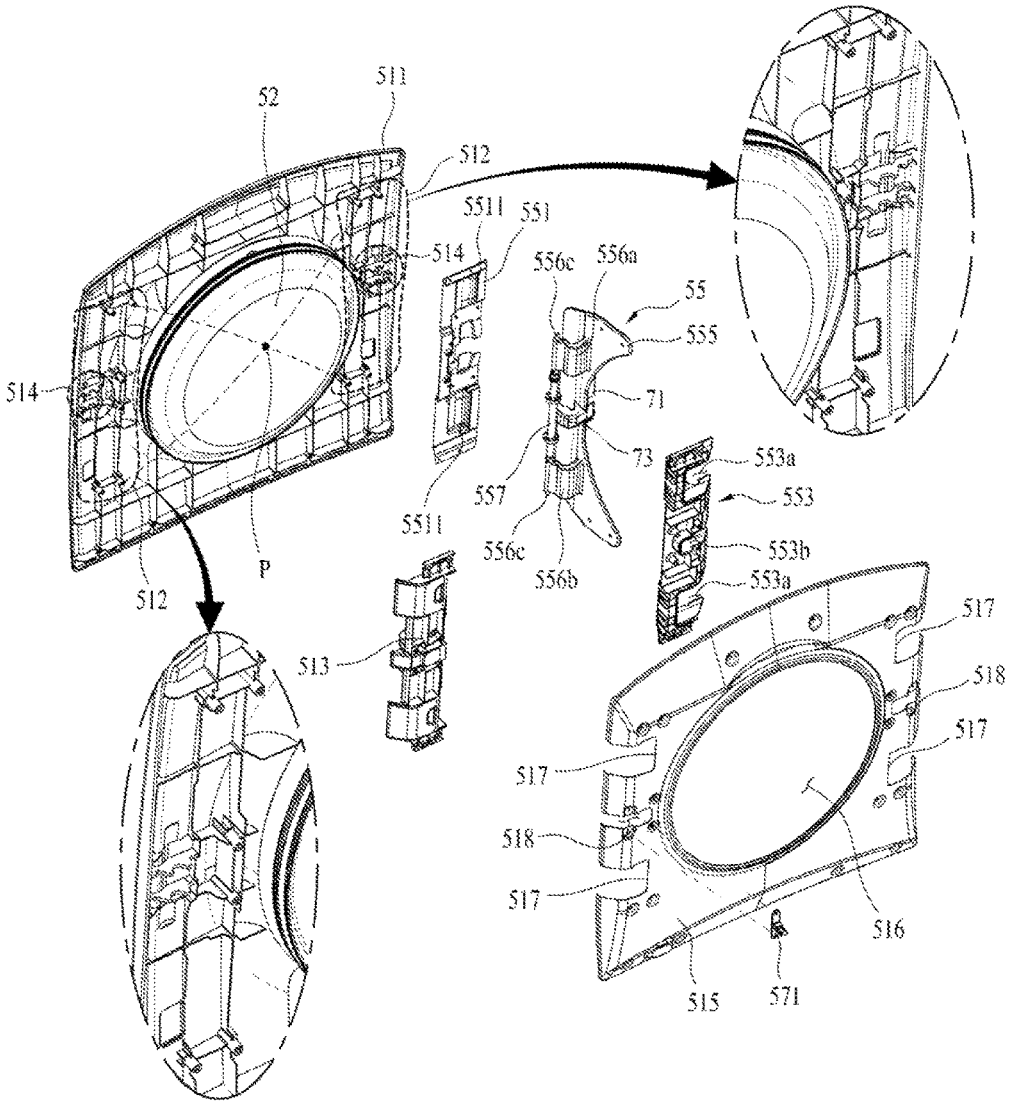
FIG. 3 is an exploded perspective view of a door according to an example embodiment.

As shown in FIG. 3, the door frame 51 may consist of an outer frame 511 and an inner frame 515.

The inner frame 515 may define one surface of the door 5 to come into contact with the front panel 11. The inner frame 515 may have a frame through-hole 516 perforated therein.

The outer frame 511 is coupled to the inner frame 515 to define part of a front surface of the laundry treatment apparatus 100. The control panel 53 (FIG. 1) may be affixed to the outer frame 511.

The outer frame 511 is provided with a door glass 52. The door glass 52 is configured to protrude into the input opening 13 through the frame through-hole 516. The door glass 52 may be formed of a transparent material.

The outer frame 511 has a seat plane 512 for coupling of the hinge unit 55. The seat plane 512 may be defined at each of both facing ends of the outer frame 511. This may serve to allow the hinge unit 55 to be secured to the left side of the door frame 51, and to be secured to the right side of the door frame 51.

In an example in which the hinge unit 55 has a completely symmetrical shape (a horizontally symmetrical and vertically symmetrical shape), a shape of the seat plane 512 located at the right side of the outer frame 511 and a shape of the seat plane 512 located at the left side of the outer frame 511 may be axially symmetrical about a virtual line passing through any reference point in the outer frame 511.

However, in the example in which the hinge unit 55 does not have a completely symmetrical shape, a shape of the seat plane 512 located at the right side of the outer frame 511 and a shape of the seat plane 512 located at the left side of the outer frame 511 may be point symmetrical about a virtual line passing through any reference point in the outer frame 511.

That is, a shape of a first seat plane may be identical to a shape of a second seat plane rotated by 180 degrees about any reference point in the outer frame 511.

FIG. 3 shows the example in which the seat planes 512 are arranged to face each other with the door glass 52 interposed therebetween. In this example, shapes of the seat planes 512 may be point symmetrical about a projection point P of the door frame 51 corresponding to a center point of the input opening 13.

That is, a second seat plane 512 located at the left side of the door 5 may have the same shape as a second seat plane 512 located at the right side of the door 5 when the second seat plane 512 is rotated by 180 degrees about the projection point P.

The above-described feature with regard to the shape of the seat plane 512 may serve to allow the hinge unit 55 to be coupled to any one of the left side and the right side of the door frame 51 and, consequently, to differently set a rotation direction of the door 5 used to open or close the input opening 13.

The hinge unit 55 includes a hinge body 555 secured to the cabinet 1, and hinge arms 556*a* and 556*b* protruding from the hinge body 555 and rotatably coupled to the door frame 51.

The hinge body 555 has a guide fixing recess 555*a* (FIG. 4) or a guide through-hole that enables fixing of the connector C, as will be described below, and provides a path for passage of a wire.

The hinge body 555 may have a vertically and horizontally symmetrical shape (e.g., a rectangular board shape), and one surface of the hinge body 555 may be concavely curved so as not to interfere with an outer circumference of the input opening 13.

The hinge arms may include a first arm 556*a* located above the guide fixing recess 555*a* and a second arm 556*b* located under the guide fixing recess 555*a*.

The guide fixing recess 555*a* may be located at a middle of the first arm 556*a* and the second arm 556*b*. That is, the first arm 556*a* and the second arm 556*b* may be symmetrically located about the guide fixing recess 555*a*.

While the respective arms 556*a* and 556*b* may protrude from the hinge body 555 without bending, as shown in FIG. 3, the respective arms 556*a* and 556*b* may first extend from the hinge body 555 and may then be bent in a direction in which the door 5 is rotated to open the input opening 13.

In the example in which the hinge body 555 has a completely symmetrical shape (a vertically and horizontally symmetrical shape) and the respective arms 556*a* and 556*b* are not bent, shapes of the above-described seat planes 512 may be axially symmetrical about a virtual vertical line passing through the projection point P.

On the other hand, in the example in which the hinge body 555 does not have a completely symmetrical shape and the respective arms 556*a* and 556*b* are bent, shapes of the seat planes 512 may be point symmetrical about the projection point P.

The first and second arms 556*a* and 556*b* may be provided respectively with protrusions 556*c* to be rotatably coupled to the door frame 51.

While the protrusions 556*c* formed at the respective arms 556*a* and 556*b* may be coupled to the door frame 51 through protrusion receiving recesses formed in the seat plane 512, the protrusions 556*c* may be coupled to the door frame 51 through a hinge supporter 551 and a supporter cover 553.

The hinge supporter 551 is secured to the seat plane 512 and has protrusion receiving regions 5511 in which the protrusions 556*c* are received respectively. The supporter cover 553 is coupled to the hinge supporter 551 to prevent the protrusions 556*c* from being separated from the protrusion receiving regions 5511.

The supporter cover 553 may have cover arm receiving recesses 553*a* for penetration of the hinge arms 556*a* and 556*b* and a cover guide receiving recess 553*b* for penetration of a wire guide 73 that may be described below.

In this example, the inner frame 515 has arm receiving recesses 517 for penetration of the hinge arms 556*a* and 556*b* and a guide receiving recess 518 for penetration of the wire guide 73. This configuration may serve to prevent the hinge arms 556*a* and 556*b* and the wire guide 73 from interfering with rotation of the door 5.

The arm receiving recesses 517 and the guide receiving recess 518 are preferably provided at each of both facing ends of the inner frame 515. This may allow the hinge unit 55 to be installed to any one of the left side and the right side of the door frame 51.

In order to prevent aesthetic deterioration of the door 5, receiving recess covers 519 (FIG. 2) are preferably separably coupled to the arm receiving recesses 517 and the guide receiving recess 518 that are not used for installation of the hinge unit 55.

As described above, the hinge unit 55 may be secured to any one of the seat planes 512 provided at both facing ends of the door frame 51. A seat plane cover 513 may be provided at one of the two seat planes 512 that is not provided with the hinge unit 55.

The seat surface cover 513 may compensate for a gap defined between the inner frame 515 and the outer frame 511 by the supporter cover 553, thereby facilitating easy coupling of the outer frame 511 and the inner frame 515.

Additionally, the hinge unit 55 may further include a rotating shaft 557 located between the first arm 556*a* and the second arm 556*b* to rotatably support the door frame 51.

Since the door frame 51 is rotatably coupled to the hinge body 555 via only the protrusions 556*c* of the hinge arms 556*a* and 556*b*, the rotating shaft 557 may be non-essential in at least one embodiment.

However, by providing the hinge unit 55 with the rotating shaft 557, stronger coupling between the door frame 51 and the hinge body 555 may be accomplished. Additionally, in the example in which the rotating shaft 557 is provided with an elastic member or an angle adjustment member, adjustment in the rotation speed or rotation angle of the door frame 51 may be possible.

To provide the hinge unit 55 with the rotating shaft 557, each of the arms 556*a* and 556*b* may have a shaft receiving portion 556*d* in which the rotating shaft 557 is received, and the outer frame 511 may have a shaft support region 514 in which the rotating shaft 557 having passed through the hinge supporter 551 is received.

Figure 4:
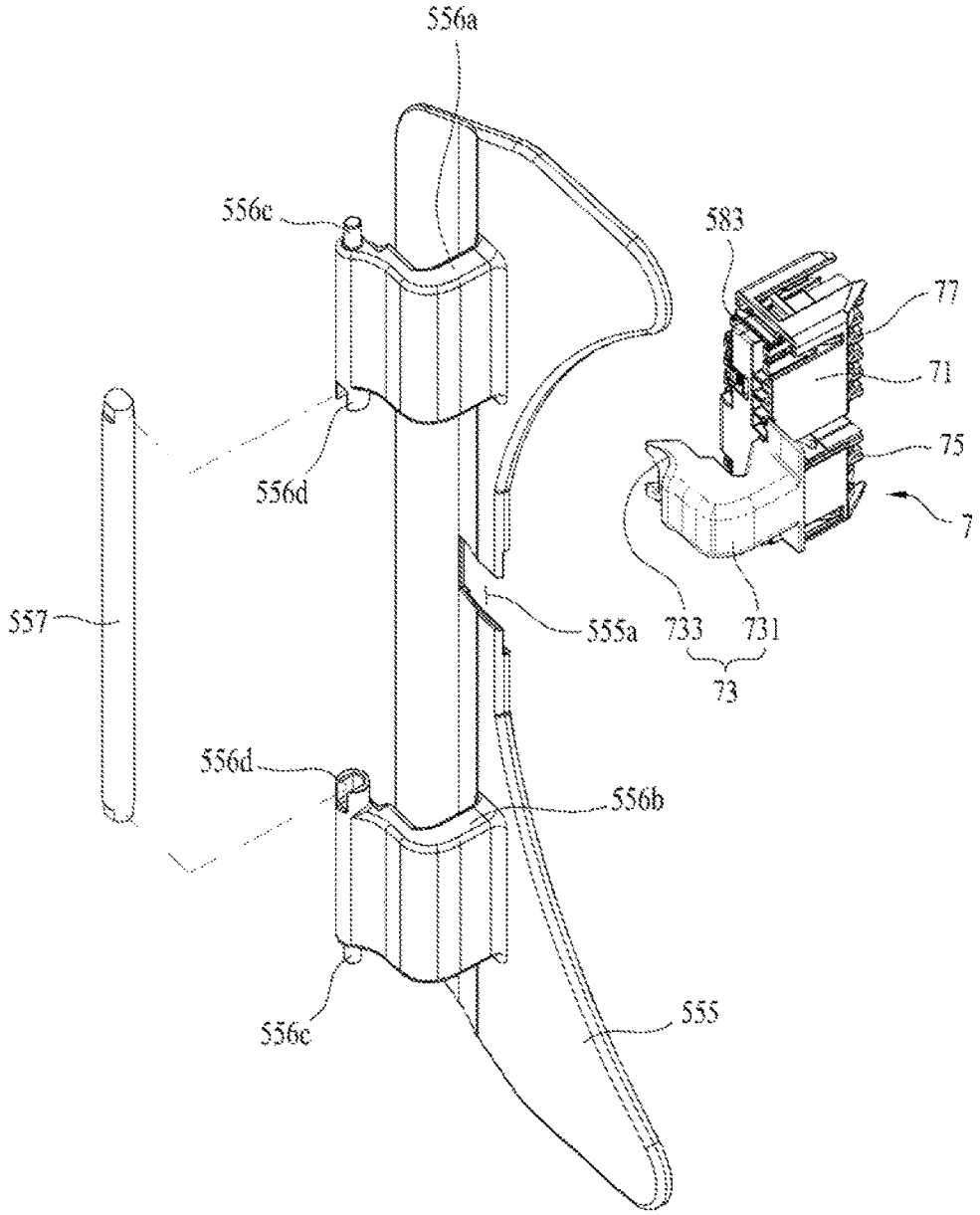
FIG. 4 is a view showing a hinge unit and a connector according to an example embodiment.

As shown in FIG. 4, the shaft receiving portions 556*d* of the first arm 556*a* and the second arm 556*b* are formed to face each other, and both ends of the rotating shaft 557 are inserted into the respective shaft receiving portions 556*d* to thereby be secured to the hinge body 551.

The rotating shaft 557 and the shaft support portion 514 as described above may be located in a space defined by the hinge supporter 551 and the supporter cover 553.

Additionally, a locking unit 57 may be provided to separably couple the door frame 51 to the front panel 11.

The locking unit 57 may include a hook 571 (FIG. 3) fitted in the guide receiving recess 518 and a hook coupling piece 573 (FIG. 5) affixed to the front panel 11 to separably receive the hook 571 therein.

In this example, the hook 571 is located at one of the guide receiving recesses 518 formed in both facing ends of the inner frame 515, more particularly, the guide receiving recess 518 that is irrelevant to installation of the hinge unit 55. When the receiving recess cover 519 is disposed over the guide receiving recess 518, the hook 571 may be disposed above the receiving recess cover 519.

As described above, the control panel 53 may serve to allow the user to input a control command (or other information) to the laundry treatment apparatus 100 and to display control information of the laundry treatment apparatus 100. Thus, the control panel 53 includes a display unit for display of control information and an input unit for input of a control command.

To perform the aforementioned functions, the control panel 53 may need to receive power from the power supply device 19 (mounted in the cabinet 1) and to perform exchange of data and control signals with the information processing device 18.

Accordingly, the connector C may be used to electrically connect the control panel 53 (installed to the door 5) to the power supply device 19 or the information processing device 18 installed in the cabinet 1.

The connector C may include a door connector 7 (i.e., a device connector) affixed to the hinge unit 55 and electrically connected to the control panel 53, and cabinet connectors 8 and 9 affixed to the front panel 11 and electrically connected to the power supply device 19 and the information processing device 18.

Figure 5:
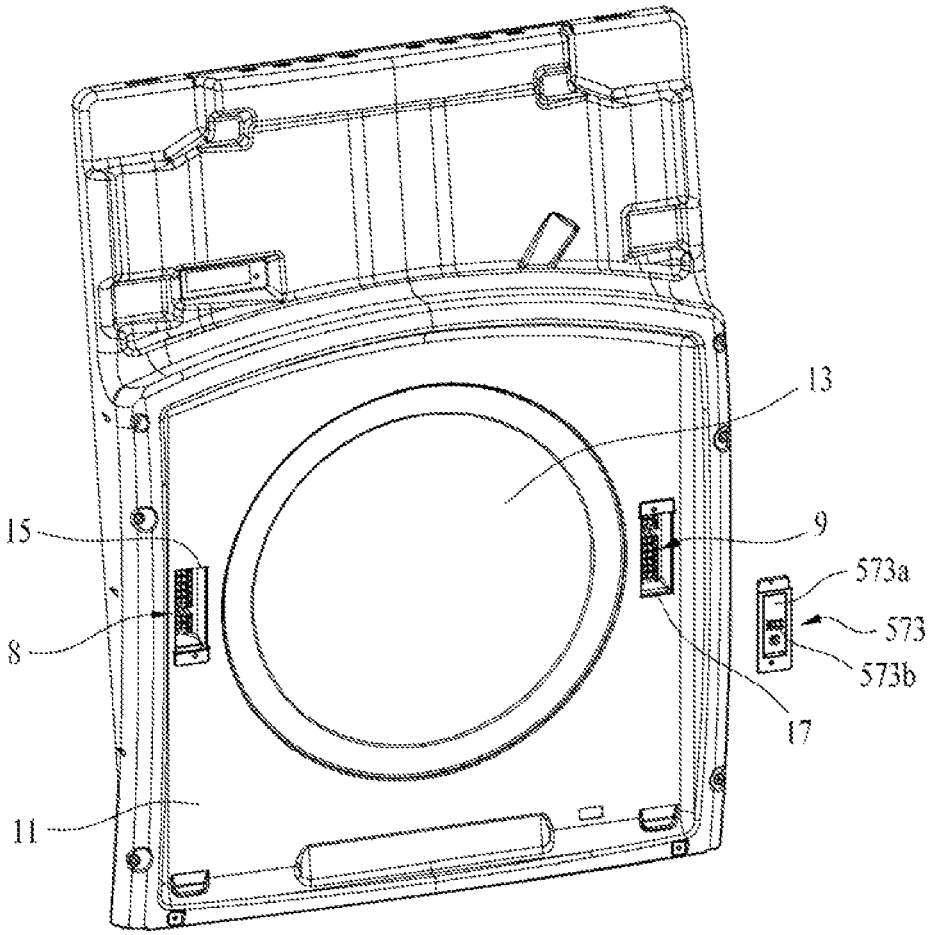
FIGS. 5, 6 and 7 are views showing a front panel and a cabinet connector included in the laundry treatment apparatus.

As shown in FIG. 5, the cabinet connectors may include a first connector 8 and a second connector 9 arranged respectively at both facing sides of the input opening 13.

The first connector 8 is inserted into a first through-hole 15 perforated in the front panel 11 so as to be exposed from the front panel 11, and the second connector 9 is inserted into a second through-hole 17 perforated in the front panel 11 so as to be exposed from the front panel 11.

The first through-hole 15 and the second through-hole 17 are symmetrically located about a center point of the input opening 13.

As shown in FIG. 6, the first connector 8 includes a cabinet connector body 81 located at a rear surface of the front panel 11 to surround the first through-hole 15, and cabinet terminals 87 and 89 installed in the cabinet connector body 81 and connected to at least one of the power supply device 19 and the information processing device 18.

FIG. 6 shows an example in which the cabinet terminals include a cabinet power terminal 87 connected to the power supply device 19 and a cabinet communication terminal 89 connected to the information processing device 18.

The cabinet power terminal 87 and the cabinet communication terminal 89 may have any of various shapes so long as they are electrically connectable to panel terminals 75 and 77.

However, for ease of description, the cabinet terminals 87 and 89 may be described below as being sockets and the panel terminals 75 and 77 may be described below as being plugs, for example. Elements 87 and 89 may be used to reference sockets.

That is, the cabinet power terminal may be the power socket 87 connected to the power supply device 19 via the power wire C2, and the cabinet communication terminal may be the communication socket 89 connected to the information processing device 18 via the communication wire C1.

The power socket 87 and the communication socket 89 may be arranged in sequence in a height direction of the cabinet connector body 81 (in a height direction of the first through-hole 15) or in a width direction of the cabinet connector body 81 (in a width direction of the first through-hole 15).

FIG. 6 shows an example in which the power socket 87 and the communication socket 89 are stacked one above another such that the power socket 87 is located at a lower portion of the cabinet connector body 81 and the communication socket 89 is located at an upper portion of the cabinet connector body 81, for example.

Figure 7:
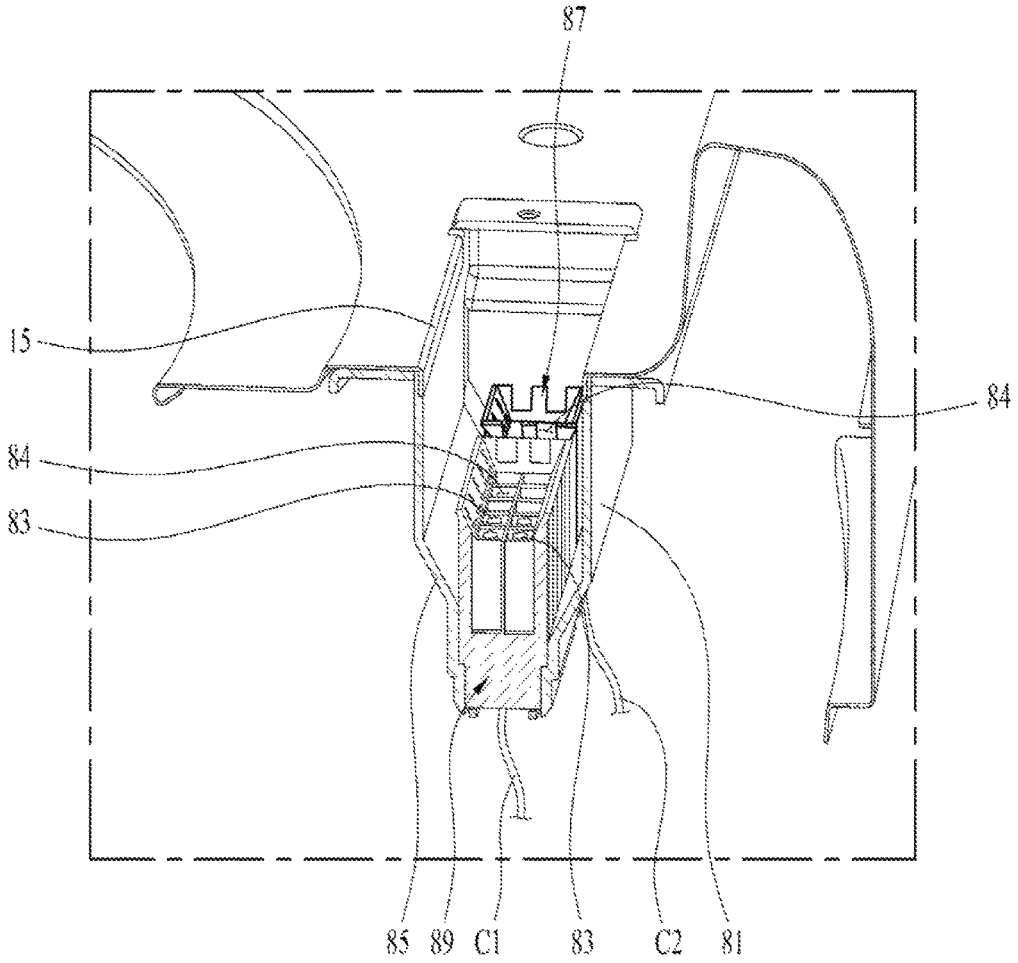

As shown in FIG. 7, the communication socket 89 may have fastener receiving recesses 84 in which communication terminal fasteners 772 (FIG. 9) provided at the door connector 7 will be received respectively, and fixing pin couplers 83 located in the fastener receiving recesses 84 and connected to the information processing device 18 via the communication wire C1.

The power socket 87 may have substantially the same configuration as the communication socket 89. That is, the power socket 87 may have fixing pin couplers connected to the power supply device 19 via the power wire C2 and fastener receiving recesses in which power terminal fasteners 752 (FIG. 9) of the door connector 7 may be received. The fixing pin couplers 83 may be located in the fastener receiving recesses 84.

The second connector 9 inserted into the second through-hole 17 may have the same configuration as the first connector 8.

As shown in FIG. 6, the second connector 9 may include a cabinet connector body 91 located at the rear surface of the front panel 11 to surround the second through-hole 17, and a cabinet power terminal (or power socket 97) and a cabinet communication terminal (or communication socket 99), which are located in the cabinet connector body 91.

However, the second connector 9 must be configured such that the communication socket 99 is located at a lower portion of the cabinet connector body 91 and the power socket 97 is located at an upper portion of the cabinet connector body 91.

This is because the hinge unit 55 may be secured to any one of the left side and the right side of the door frame 51 and the door connector 7 is secured to the hinge unit 55 and, therefore, in order to vary a position of the hinge unit 55, it may be necessary to rotate the hinge body 555 and the door connector 7 by 180 degrees about the projection point P (FIG. 3).

The communication socket 99 and the power socket 97 (of the second connector 9) may have the same configurations as the communication socket 89 and the power socket 87 (of the first connector).

The hook fastening piece 573 of the locking unit 57 may include a body 573*a* separably coupled to the front panel 11 and a hook receiving hole 573*b* perforated in the body 573*a* to separably receive the hook 571 therein.

As shown in FIG. 5, the body 573*a* is located at a position corresponding to the hook 571 to close the through-hole 15 or 17. As such, when the hinge unit 55 is fixed toward the first through-hole 15, the body 573*a* closes the second through-hole 17 to prevent the second connector 9 from being exposed outward. When the hinge unit 55 is fixed toward the second through-hole 17, the body 573*a* closes the first through-hole 15 to prevent the first connector 8 from being exposed outward.

Figure 8:
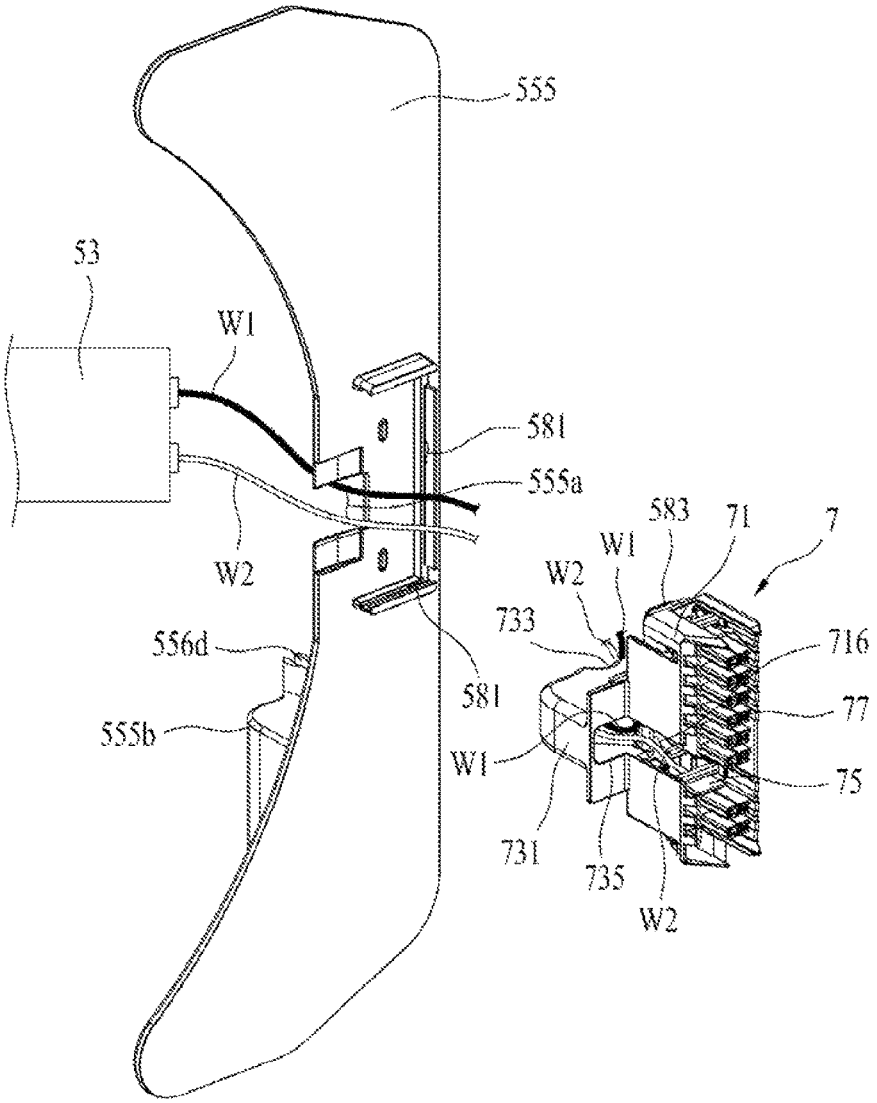
FIGS. 8, 9, 10 and 11 are views showing a door connector (device connector).

As shown in FIG. 8, the door connector 7 (or device connector) includes a connector body 71, the wire guide 73 and the panel terminals 75 and 77 (or device terminals).

The connector body 71 is affixed to the hinge body 555 and separably coupled to the cabinet connector body 81 or 91, and the panel terminals 75 and 77 are received in the connector body 71 so as to be electrically connected to the control panel 53.

Accordingly, when the connector body 71 is inserted into the cabinet connector body 81 or 91, the panel terminals 75 and 77 are connected to the cabinet terminals 87 and 89 (97 and 99) so as to electrically connect the control panel 53 to the power supply device 19 and the information processing device 18.

The wire guide 73 extends from the connector body 71 to the door 5 and penetrates the hinge body 555.

The connector body 71 may be secured to the hinge body 555 as the wire guide 73 is inserted into the guide fixing recess 555*a* (of the hinge body 555) and may be secured to the hinge body 555 via a body fixing structure.

The body fixing structure may include a slot 581 formed in the hinge body 555 and a slotted protrusion 583 formed at the connector body 71.

Figure 9:
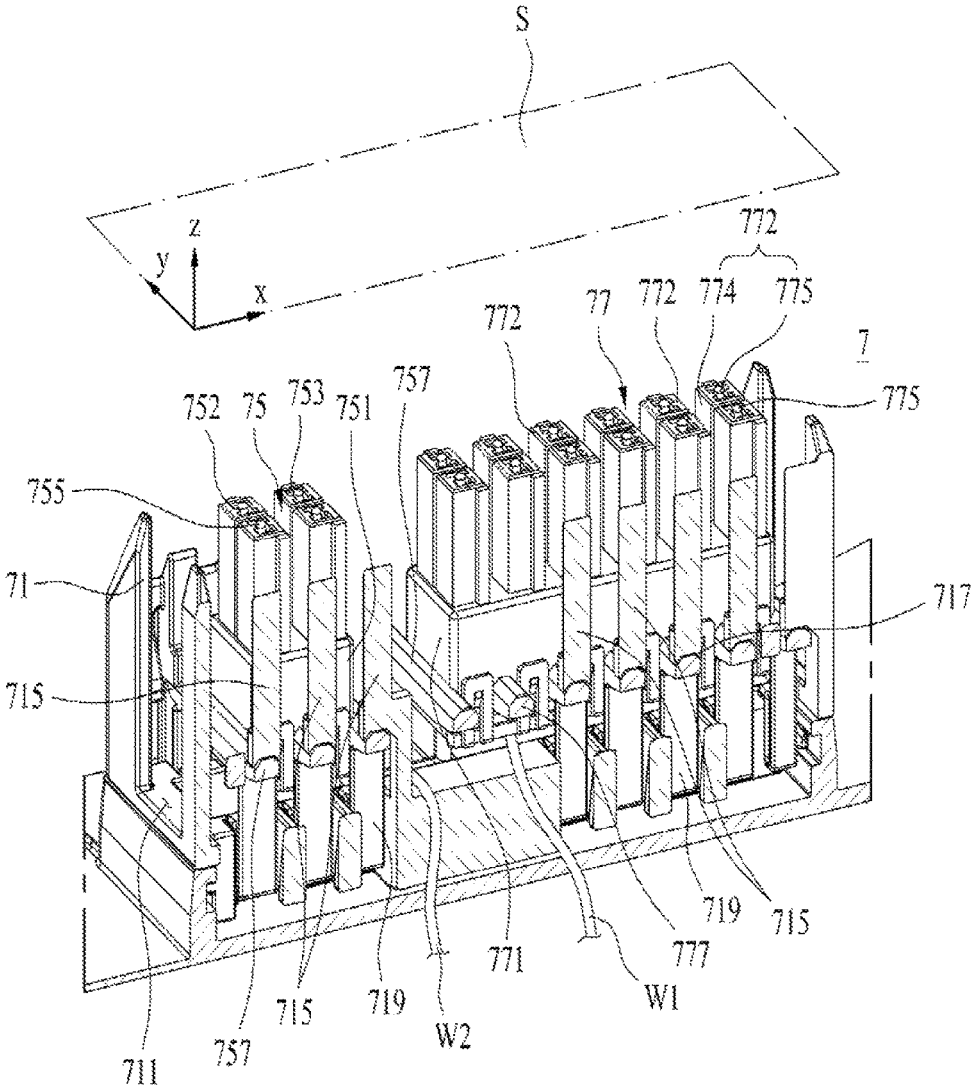

As shown in FIG. 9, the connector body 71 may be in a form of a cube having an open top side, and having a receiving recess 711 in which the panel terminals 75 and 77 are received.

Provided in the receiving recess 711 are flange guides 715 extending in a height direction of the connector body 71 (along the Z-axis in a direction perpendicular to the cross section S of the cabinet connector).

Figure 10:
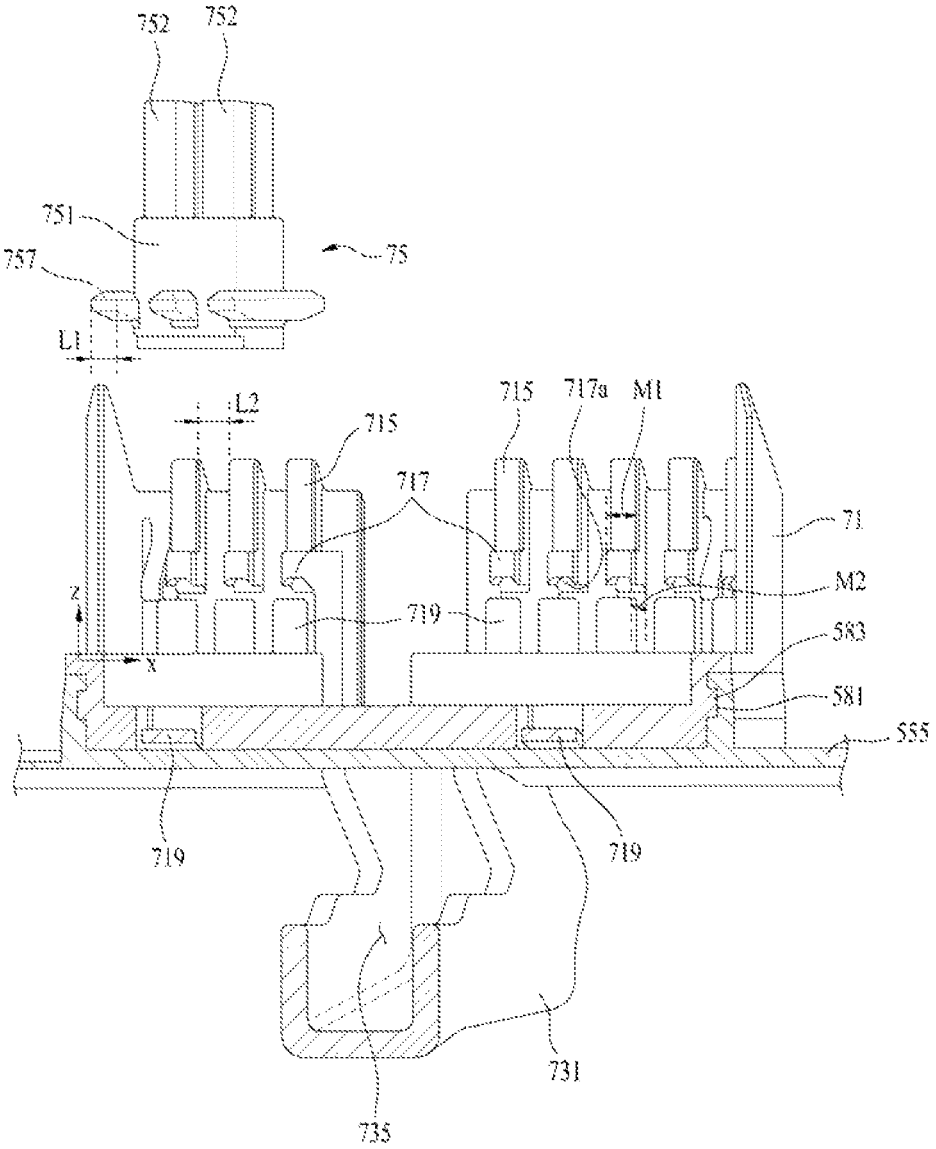

The flange guides 715 may be arranged at both facing sides of the receiving recess 711. As shown in FIG. 10, the flange guides 715 may be spaced apart from one another by a prescribed distance in a longitudinal direction of the receiving recess 711 (along the X-axis).

At least one of first flange support portions 719 and second flange support portions 717 may be provided in the receiving recess 711 to support the panel terminals 75 and 77.

The first flange support portions 719 may be configured to support the panel terminals 75 and 77 (more particularly, configured to support flanges 757 and 777 formed at the panel terminals 75 and 77) to allow the panel terminals 75 and 77 to move in a height direction of the connector body 71 (along the Z-axis).

The first flange support portions 719 may be downwardly spaced apart from the second flange support portions 717, and the flanges 757 and 777 of the panel terminals 75 and 77 may be inserted through a gap between the first flange support portions 719 and the second flange support portions 717.

Figure 11:
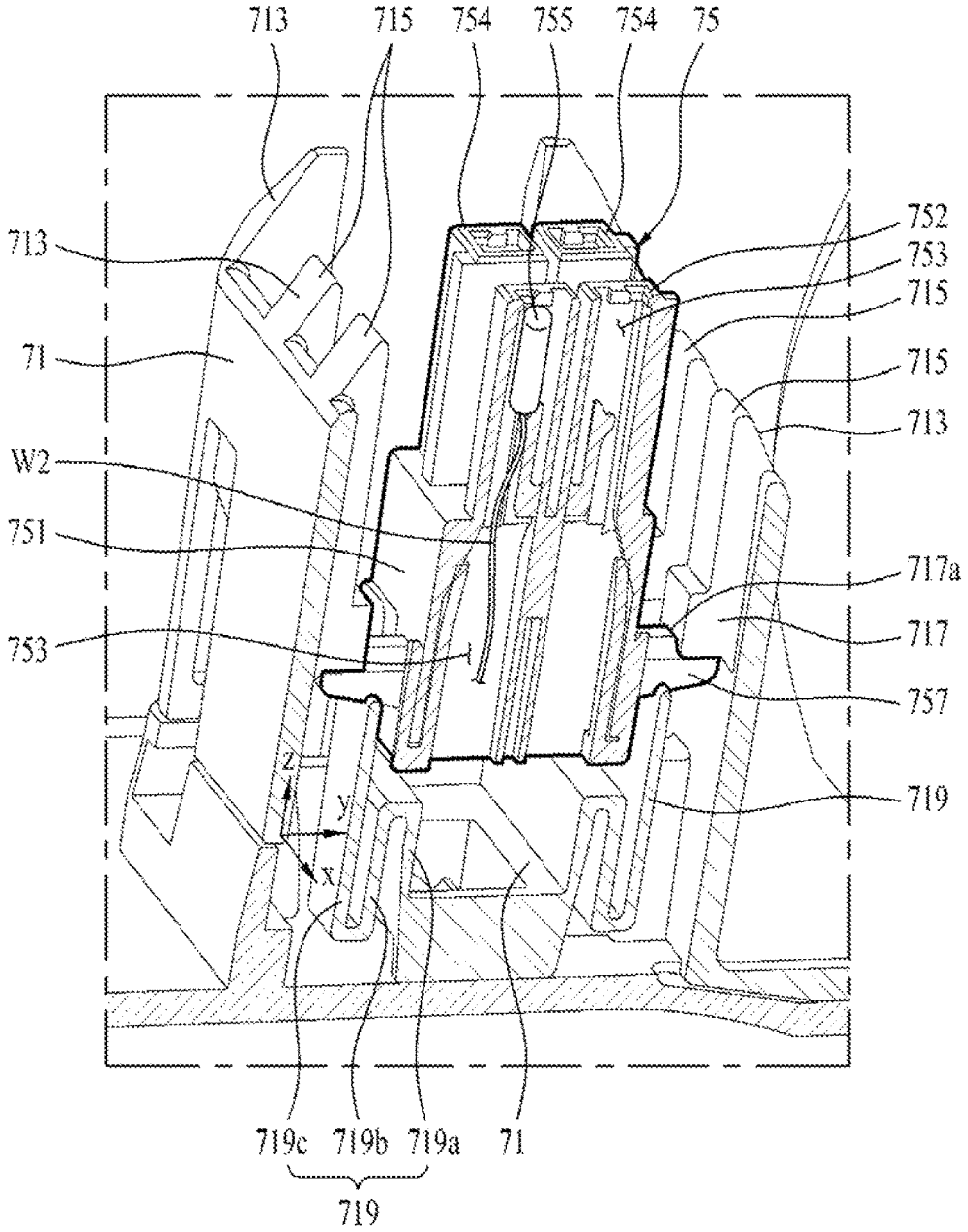

As shown in FIG. 11, each of the first flange support portions 719 may include a fixing portion 719*a* extending from a bottom surface of the receiving recess 711 in a height direction of the connector body 71 (along the Z-axis), a bent portion 719*b* extending from a distal end of the fixing portion 719*a* to the bottom surface of the receiving recess 711, and an extension portion 719*c* extending from a distal end of the bent portion 719*b* in a height direction of the connector body 71 to support the panel terminals 75 and 77.

The first flange support portions 719 may apply elastic force to the panel terminals 75 and 77 via the bent portion 719*b* thereof. As such, the panel terminals 75 and 77 supported by the first flange support portions 719 are movable in a direction perpendicular to the cross section S of the cabinet connectors 8 and 9 (along the Z-axis).

Meanwhile, the above-described configuration of the first flange support portions 719 is merely an example and the first flange support portions 719 may have any of other altered configurations so long as they achieve the above-described functions.

The second flange support portions 717 may serve to support the panel terminals 75 and 77 to allow the panel terminals 75 and 77 to move in at least one direction among a longitudinal direction of the connector body 71 (along the X-axis in a longitudinal direction of the cross section S of the cabinet connector) and a width direction of the connector body 71 (along the Y-axis in a width direction of the cross section S).

The second flange support portions 717 protrude from the respective flange guides 715 to the center of the receiving recess 711. The second flange support portions 717 have flange receiving grooves 717*a* in which the flanges 757 and 777 of the panel terminals 75 and 77 are received.

The connector body 71 is provided with a slope 713 at an outer circumference thereof. The slope 713 is coupled to a slope guide 85 of the cabinet connector body 81 when the connector body 71 is inserted into the cabinet connector body 81, thereby assisting the panel terminals 75 and 77 in coupling with the cabinet terminals 87 and 89 (97 and 99).

Meanwhile, as shown in FIG. 8, the connector body 71 has a removal region 716 that communicates the receiving recess 711 with outside of the connector body 71.

The removal region 716 may be an aperture perforated in the connector body 71. More specifically, as shown in the drawing, the removal region 716 may be an incision formed in the connector body 71 in a height direction of the connector body 71.

The panel terminals, which are movable in the receiving recess 711, may include a panel power terminal 75 separably coupled to the cabinet power terminal 87 (or 97), and a panel communication terminal 77 separably coupled to the cabinet communication terminal 89 or 99.

Assuming that the cabinet power terminals 87 and 97 and the cabinet communication terminals 89 and 99 are in forms of sockets, the panel power terminal is a power plug 75 coupled to the power socket 87 (or 97), and the panel communication terminal is a communication plug 77 coupled to the communication socket 89 (or 99).

As shown in FIG. 11, the power plug 75 may include a power plug body 751 (or power terminal body) received in the receiving recess 711, the flange 757 protruding from the power plug body 751 in a width direction of the connector body 71 (along the Y-axis), and the power terminal fasteners 752 protruding from the power plug body 751 in a height direction of the connector body 71 (along the Z-axis).

The power plug body 751 may be in the form of a cube having an open bottom side, and the power terminal fasteners 752 may protrude from an upper surface of the power plug body 751.

The power terminal fasteners 752 may be inserted into the fastener receiving recesses 84 formed in the power socket 87 (or 97) when the power plug 75 is coupled to the power socket 87 (or 97).

Each of the power terminal fasteners 752 includes a fastener body 754 protruding from the power plug body 751, a fastener through-bore 753 formed through the fastener body 754, and a power line fixing pin 755 (or conductor) fixed in the fastener through-bore 753 and connected to the control panel 53 through a panel power wire W2.

The power line fixing pin 755 may come into contact with the fixing pin coupler 83 connected to the power wire C2 when the power terminal fastener 752 is inserted into the fastener receiving recess 84. As such, once the power plug 75 is coupled to the power socket 87 (or 97), the power line fixing pin 755 is connected to the fixing pin coupler 83, which may accomplish electrical connection between the power supply device 19 and the control panel 53.

The flanges 757 may be formed at both facing ends of the power plug body 751 and may be spaced apart from one another by a prescribed distance.

As shown in FIG. 10, a width L1 of one flange 757 is less than a distance L2 between the two neighboring flange guides 715.

Accordingly, as the flange 757 is inserted into a space defined between the flange guides 715, the power plug body 751 may be moved into the receiving recess 711. The power plug body 751 located in the receiving recess 711 may be fixed to the connector body 71 as the flange 757 is inserted into a space between the first flange support portion 719 and the second flange support portion 717.

When the power plug body 751 is secured to the connector body 71, a lower surface of the flange 757 is supported by the first flange support portion 719 and an upper surface of the flange 757 is inserted into the flange receiving groove 717*a*.

A width M1 of the flange receiving groove 717*a* is set to allow the flange 757 to be movable along the X-axis in the flange receiving groove 717*a*. A depth M2 of the flange receiving groove 717*a* is set to allow the flange 757 to be movable along the Y-axis in the flange receiving groove 717*a*.

As such, the power plug 75 is movable along the Z-axis by the first flange support portion 719 and is movable along the X-axis and the Y-axis by the second flange support portion 717.

The reason why the power plug 75 is configured to be movable along the X-axis, the Y-axis and the Z-axis in the flange receiving groove 717*a* is to assist the power plug 75 in being easily coupled to the power socket 87.

All mechanical devices may have a tolerance. The first flange support portions 719 and the second flange support portions 717 may serve to ensure that the door connector 7 (or device connector) is coupled to the cabinet connector 8 (or 9) even when a position or shape of the cabinet connector 8 (or 9) deviates from an allowable tolerance range.

The communication plug 77 received in the connector body 71 may have the same configuration as the above-described power plug 75. That is, as shown in FIG. 9, the communication plug 77 includes a communication plug body 771 (or communication terminal body) located in the receiving recess 711, the flanges 777 located respectively at both facing ends of the communication plug body 771, and the communication terminal fasteners 772 protruding from an upper surface of the communication plug body 771.

The communication terminal fasteners 772 may also have the same configuration as the power terminal fasteners 752. That is, each of the communication terminal fasteners 772 includes a fastener body 774, a fastener through-bore 773, and a communication line fixing pin 775 fixed in the fastener through-bore and connected to the control panel 53 through a communication wire W1.

As such, once the communication plug 77 is coupled to the communication socket 89 (or 99), the communication line fixing pin 775 is connected to the fixing pin coupler 83, which may accomplish electrical connection between the information processing device 18 and the control panel 53.

As shown in FIG. 8, the wire guide 73 includes a guide body 731 extending from the connector body 71, and a wire receiving region 735 formed in the guide body 731 to receive the wire W1 or W2 therein.

The guide body 731 is configured to penetrate the hinge body 555 through the guide fixing recess 555*a*, and one end (or free end) of the guide body 731 is located inside the door frame 51.

The end of the guide body 731 located inside the door frame 51 may be provided with a rotating shaft support portion 733 in which an outer circumference of the rotating shaft 557 is received.

The wire receiving region 735 may serve to guide the wire W1 or W2, removed from the receiving recess 711 through the removal region 716 of the connector body 71, to a space inside the door frame 51. As such, the wire W1 or W2 may accomplish connection between the panel terminals 75 and 77 (or device terminals) and the control panel 53 without interference of the hinge unit 55.

In the laundry treatment apparatus 100, the hinge unit 55 may be coupled to any one of the left side and the right side of the door frame 51, which enables setting of a rotation direction of the door 5 in a desired manner.

Additionally, in the laundry treatment apparatus 100, regardless of whether the hinge unit 55 is installed at the left side or the right side of the input opening 13, the control panel 53 installed to the door 5 may be connected to the information processing device 18 and the power supply device 19 installed in the cabinet 1 via the connector C.

As the door connector 7 is secured to the hinge unit 55 and the cabinet connectors 8 and 9 are located respectively at both facing sides of the input opening 13 where the hinge unit 55 may be coupled, coupling between the door connector 7 and the cabinet connectors 8 and 9 is accomplished when the hinge unit 55 is assembled to the front panel 11, which results in easy assembly of the laundry treatment apparatus 100.

Embodiments may have the effect of providing a connector that connects an electronic device installed in a main body (cabinet) and an electronic device installed to a device separated from the main body to each other, and a laundry treatment apparatus having the same.

Embodiments may have the effect of providing a connector that connects a door, a rotation direction of which is variable, and an electronic device installed to the door to an electronic device installed in a main body, and a laundry treatment apparatus having the same.

Embodiments may be directed to connectors and laundry treatment apparatuses having the same that substantially obviate one or more problems due to limitations and disadvantages of disadvantageous arrangements.

One object may be to provide a connector that connects an electronic device installed in a main body (cabinet) and an electronic device installed to a device separated from the main body to each other, and a laundry treatment apparatus having the same.

Another object may be to provide a connector that connects a door, a rotation direction of which is variable, and an electronic device installed to the door to an electronic device installed in a main body, and a laundry treatment apparatus having the same.

In accordance with one embodiment, a laundry treatment apparatus may include: a cabinet having an input opening for introduction of laundry, a laundry receptacle configured to store laundry introduced through the input opening, and a door including a door frame configured to open or close the input opening, a hinge unit configured to rotatably couple the door frame to the cabinet, and a control panel installed to the door frame to enable input of a control command or output of control information. The laundry treatment apparatus may further include a cabinet connector installed to the cabinet, the cabinet connector being configured to transmit and receive at least one of power and a control signal, and a door connector separably coupled to the cabinet connector, the door connector being configured to connect the control panel to the cabinet connector. The door connector may be movable along at least two of the X-axis and the Y-axis defining a plane parallel to a cross section of the cabinet connector and the Z-axis perpendicular to the cross section of the cabinet connector.

The cabinet connector may include a cabinet terminal secured to the cabinet. The cabinet terminal may be connected to at least one of a power supply device for supply of power and an information processing device for transmission/reception of a control signal. The door connector may include a connector body secured to the hinge unit. The connector body may have a receiving recess and a panel terminal separably coupled to the cabinet terminal to connect the control panel to the cabinet terminal. The panel terminal may be movable in the receiving recess along at least two of the X-axis, the Y-axis and the Z-axis.

The door connector may include a first support portion located in the receiving recess to elastically support the panel terminal along the Z-axis, and a second support portion located in the receiving recess to support the panel terminal such that the panel terminal is movable along at least one of the X-axis or the Y-axis.

The cabinet terminal may take the form of a socket. The panel terminal may take the form of a plug.

The door connector may further include a slope formed at an outer circumference of the connector body. The cabinet connector may include a cabinet connector body secured to the cabinet. The cabinet connector body may be configured to receive the cabinet terminal therein and a guide formed at the cabinet connector body to be coupled to the slope, thereby guiding the panel terminal to the cabinet terminal.

The panel terminal may include a terminal body located in the receiving recess, a flange formed at each of both facing ends of the terminal body and supported by the first support portion and the second support portion, and a terminal fastener located in the terminal body so as to be separably connected to the cabinet terminal. The terminal fastener may be connected to the control panel via a wire.

The first support portion may include a fixing portion protruding from a bottom surface of the connector body toward the flange, a bent portion extending from a distal end of the fixing portion toward the bottom surface of the connector body, and an extension portion extending from a distal end of the bent portion toward the flange to support the flange.

The connector body may further include a flange guide protruding from an inner circumference of the receiving recess toward the terminal body along the Z-axis (in a depth direction of the receiving recess) and the second support portion may protrude from the flange guide and has a flange receiving groove configured to receive an upper surface of the flange therein.

The flange receiving groove may have a width to allow the flange to be movable along the X-axis in the flange receiving groove. The flange receiving groove may have a depth to allow the flange to be movable along the Y-axis in the flange receiving groove.

In accordance with another embodiment, a connector may include: a cabinet connector secured to a cabinet incorporating at least one of a power supply device and an information processing device and a device connector installed to a control object device to be controlled by at least one of the power supply device and the information processing device. The device connector may be separably connected to the cabinet connector. The device connector may be movable along at least two of the X-axis and the Y-axis defining a plane parallel to a cross section of the cabinet connector and the Z-axis perpendicular to the cross section of the cabinet connector.

The cabinet connector may include a cabinet terminal secured to the cabinet. The cabinet terminal may be connected to at least one of the power supply device for supply of power and the information processing device for transmission/reception of a control signal. The device connector may include a connector body having a receiving recess, a device terminal separably coupled to the cabinet terminal to connect the control object device to the cabinet terminal, the device terminal being movable in the receiving recess along at least two of the X-axis, the Y-axis and the Z-axis, a first support portion located in the receiving recess to elastically support the device terminal along the Z-axis and a second support portion located in the receiving recess to support the device terminal such that the device terminal is movable along at least one of the X-axis or the Y-axis.

The cabinet terminal may take the form of a socket. The device terminal may take the form of a plug.

The plug may include a plug body inserted into the receiving recess, a flange formed at each of both facing ends of the plug body and supported by the first support portion and the second support portion in the receiving recess and a plug fastener located in the plug body so as to be separably connected to the socket. The plug fastener may be connected to the control object device via a wire.

The connector body may further include a flange guide protruding from an inner circumference of the receiving recess toward the plug body along the Z-axis. The first support portion may include a fixing portion protruding from a bottom surface of the connector body toward the flange, a bent portion extending from the fixing portion toward the bottom surface of the connector body and an extension portion extending from the bent portion toward the flange to support the flange. The second support portion may protrude from the flange guide and has a flange receiving groove configured to receive an upper surface of the flange therein.

The flange receiving groove may have a width to allow the flange to be movable along the X-axis in the flange receiving groove. The flange receiving groove may have a depth to allow the flange to be movable along the Y-axis in the flange receiving groove.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment apparatus comprising:

a cabinet having an input opening;

a laundry receptacle configured to store laundry received through the input opening;

a door including a door frame configured to open or close the input opening, a hinge unit configured to rotatably couple the door frame to the cabinet, and a control panel at the door frame to input a control command or to output control information;

a cabinet connector at the cabinet, the cabinet connector being configured to transmit and receive at least one of power and a control signal; and a door connector separably coupled to the cabinet connector, the door connector being configured to couple the control panel to the cabinet connector, wherein the door connector is movable along at least two of an X-axis and a Y-axis defining a plane parallel to a cross section of the cabinet connector and a Z-axis perpendicular to the cross section of the cabinet connector, wherein the cabinet connector includes a cabinet terminal at the cabinet, the cabinet terminal to couple to at least one of a power supply device for supply of power and an information processing device for transmission/reception of a control signal, and the door connector includes:

a connector body at the hinge unit, the connector body having a receiving recess; and a panel terminal separably coupled to the cabinet terminal so as to couple the control panel to the cabinet terminal, the panel terminal to move in the receiving recess along at least two of the X-axis, the Y-axis and the Z-axis.

2. The apparatus according to claim 1, wherein the door connector includes:

a first support portion at the receiving recess to elastically support the panel terminal along the Z-axis; and a second support portion at the receiving recess to support the panel terminal such that the panel terminal is movable along the X-axis or the Y-axis.

3. The apparatus according to claim 2, wherein the cabinet terminal is a socket; and the panel terminal is a plug.

4. The apparatus according to claim 2, wherein the door connector further includes a slope formed at an outer circumference of the connector body; and the cabinet connector includes:

a cabinet connector body at the cabinet, the cabinet connector body being configured to receive the cabinet terminal; and a guide formed at the cabinet connector body to couple to the slope so as to guide the panel terminal to the cabinet terminal.

5. The apparatus according to claim 2, wherein the panel terminal includes:

a terminal body at the receiving recess;

a flange at each of both facing ends of the terminal body, and the flange to be supported by the first support portion and the second support portion; and a terminal fastener at the terminal body to be separably coupled to the cabinet terminal, the terminal fastener to couple to the control panel via a wire.

6. The apparatus according to claim 5, wherein the first support portion includes:

a fixing portion to protrude from a bottom surface of the connector body toward the flange;

a bent portion to extend from a distal end of the fixing portion toward the bottom surface of the connector body; and an extension portion to extend from a distal end of the bent portion toward the flange to support the flange.

7. The apparatus according to claim 5, wherein the connector body includes a flange guide to protrude from an inner circumference of the receiving recess toward the terminal body along the Z-axis in a depth direction of the receiving recess, and the second support portion to protrude from the flange guide, and the second support portion has a flange receiving groove configured to receive an upper surface of the flange.

8. The apparatus according to claim 7, wherein the flange receiving groove has a width to allow the flange to be movable along the X-axis in the flange receiving groove, and the flange receiving groove has a depth to allow the flange to be movable along the Y-axis in the flange receiving groove.

9. An apparatus comprising:

a cabinet having an input opening;

a door frame configured to open or close the input opening;

a hinge unit to rotatably couple the door frame to the cabinet;

a control panel at the door frame;

a cabinet connector at the cabinet to receive power from a power supply device or to transmit a control signal to a processing device; and a door connector to couple to the cabinet connector, the door connector to couple the control panel to the cabinet connector, wherein the door connector is movable along at least two of an X-axis and a Y-axis defining a plane parallel to a cross section of the cabinet connector and a Z-axis perpendicular to the cross section of the cabinet connector, wherein the cabinet connector includes a cabinet terminal to couple to one of the power supply device and the processing device; and the door connector includes:

a connector body at the hinge unit, the connector body having a receiving recess; and a panel terminal to couple to the cabinet terminal to couple the control panel to the cabinet terminal, the panel terminal being movable in the receiving recess along at least two of the X-axis, the Y-axis and the Z-axis.

10. The apparatus according to claim 9, wherein the door connector includes:

a first support portion at the receiving recess to support the panel terminal along the Z-axis; and a second support portion at the receiving recess to support the panel terminal such that the panel terminal is movable along the X-axis or the Y-axis.

11. The apparatus according to claim 10, wherein the door connector includes a slope at a circumference of the connector body; and the cabinet connector includes:

a cabinet connector body to receive the cabinet terminal; and a guide to couple to the slope to guide the panel terminal to the cabinet terminal.

12. The apparatus according to claim 10, wherein the panel terminal includes:

a terminal body at the receiving recess;

a flange at each of both ends of the terminal body, and the flange to be supported by the first support portion and the second support portion; and a terminal fastener to couple to the cabinet terminal, the terminal fastener to couple to the control panel via a wire.

* * * * *